US009744591B2

(12) United States Patent
Fukae et al.

(10) Patent No.: US 9,744,591 B2
(45) **Date of Patent: *Aug. 29, 2017**

(54) IRON BASE SINTERED SLIDING MEMBER AND METHOD FOR PRODUCING SAME

(71) Applicant: HITACHI CHEMICAL COMPANY, LTD., Tokyo (JP)

(72) Inventors: Daisuke Fukae, Matsudo (JP); Hideaki Kawata, Matsudo (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 60 days.

This patent is subject to a terminal disclaimer.

(21) Appl. No.: 14/218,530

(22) Filed: Mar. 18, 2014

(65) Prior Publication Data

US 2014/0286812 A1 Sep. 25, 2014

(30) Foreign Application Priority Data

Mar. 19, 2013 (JP) ..... 2013-056691

(51) Int. Cl.

| | |
|---|---|
| ***B22F 3/12*** | (2006.01) |
| ***C22C 33/02*** | (2006.01) |
| ***C22C 1/10*** | (2006.01) |

(52) U.S. Cl.

CPC ..... *B22F 3/12* (2013.01); *C22C 1/10* (2013.01); *C22C 33/02* (2013.01);
(Continued)

(58) Field of Classification Search

CPC ..... C22C 33/0221; C22C 1/10; C22C 33/02; C22C 33/0228; C22C 33/0235;
(Continued)

(56) References Cited

U.S. PATENT DOCUMENTS

| | | | |
|---|---|---|---|
| 3,918,923 | A | 11/1975 | Inoue |
| 4,233,071 | A | 11/1980 | Bierlein et al. |

(Continued)

FOREIGN PATENT DOCUMENTS

| | | |
|---|---|---|
| DE | 907 419 | 3/1954 |
| GB | 2495209 A | 4/2013 |

(Continued)

OTHER PUBLICATIONS

Extended Search Report issued in European Patent Application No. 14160621.0 dated Jun. 27, 2014.

(Continued)

*Primary Examiner* — Colleen Dunn
*Assistant Examiner* — Anthony Liang
(74) *Attorney, Agent, or Firm* — Oliff PLC

(57) ABSTRACT

An iron-based sintered sliding member is provided in which solid lubricating agent is dispersed uniformly inside of powder particles in addition to inside of pores and particle interfaces of the powder, the agent is strongly fixed, and sliding properties and mechanical strength are superior. The iron-based sintered sliding member contains S: 3.24 to 8.10 mass %, remainder: Fe and inevitable impurities, as an overall composition; the metallic structure includes a ferrite base in which sulfide particles are dispersed, and pores; and the sulfide particles are dispersed at a ratio of 15 to 30 vol % versus the base.

14 Claims, 1 Drawing Sheet

(52) U.S. Cl.
CPC ..... *C22C 33/0285* (2013.01); *B22F 2302/40* (2013.01); *B22F 2998/10* (2013.01)

(58) Field of Classification Search
CPC ..... C22C 33/0207; C22C 33/0264; C22C 33/0278; C22C 33/0285; C22C 33/0292; C22C 38/16; B22F 3/02; B22F 3/10; B22F 3/12; B22F 2302/40; B22F 2302/406; B22F 2998/10
See application file for complete search history.

(56) References Cited

U.S. PATENT DOCUMENTS

| | | | |
|---|---|---|---|
| 5,259,860 | A | 11/1993 | Ikenoue et al. |
| 2005/0040358 | A1 | 2/2005 | Chikahata et al. |
| 2006/0032328 | A1 | 2/2006 | Chikahata et al. |
| 2006/0219054 | A1 | 10/2006 | Kawata et al. |

FOREIGN PATENT DOCUMENTS

| | | | | |
|---|---|---|---|---|
| JP | A-47-21314 | | | 10/1972 |
| JP | A-49-37806 | | | 4/1974 |
| JP | S50-75510 | A | | 6/1975 |
| JP | A-56-62951 | | | 5/1981 |
| JP | S56-146863 | A | | 11/1981 |
| JP | A-64-15350 | | | 1/1989 |
| JP | A-4-157140 | | | 5/1992 |
| JP | A-2000-282166 | | | 10/2000 |
| JP | 2002332552 | A | * | 11/2002 |
| JP | A-2002-332552 | | | 11/2002 |
| JP | 2003-201548 | A | | 7/2003 |
| JP | A-2006-52468 | | | 2/2006 |
| JP | A-2009-155696 | | | 7/2009 |
| KR | 2006-0105499 | A | | 10/2006 |
| WO | WO 98/25720 | A1 | | 6/1998 |
| WO | WO 00/00656 | A1 | | 1/2000 |

OTHER PUBLICATIONS

Aug. 7, 2015 Notice of Reasons for Rejection issued in Korean Patent Application No. 10-2014-0031645.
Nov. 16, 2016 Notification of Reason for Refusal issued in Japanese Application No. 2013-056691.

* cited by examiner

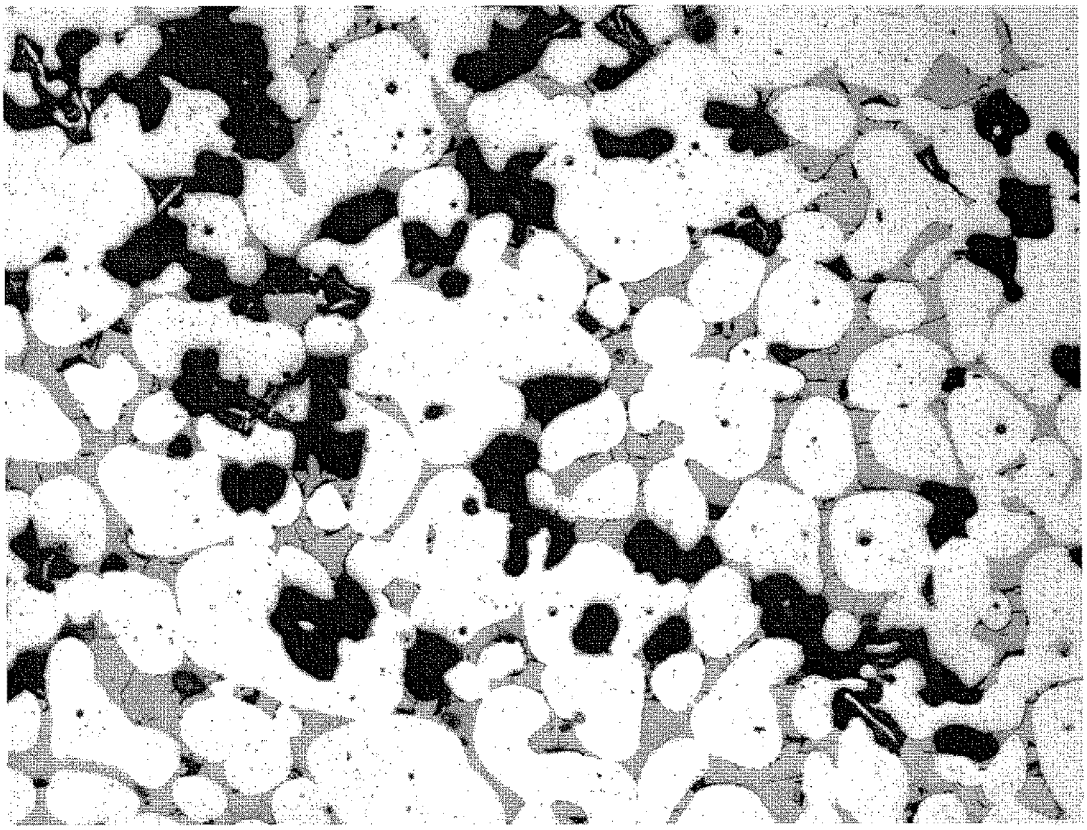
100 μm

IRON BASE SINTERED SLIDING MEMBER AND METHOD FOR PRODUCING SAME

TECHNICAL FIELD

The present invention relates to a sliding member that may be appropriately used as a sliding part on a sliding surface to which high surface pressure is applied, such as a valve guide or valve sheet of an internal combustion engine, a vane or roller of a rotary compressor, sliding parts of a turbo charger, or a driving portion or sliding portion of a vehicle, machine tool or industrial machine or the like, for example, and in particular, relates to an iron-based sintered sliding member produced by a powder metallurgical method in which raw material powder containing Fe as a main component is compacted, and the compact is sintered, and relates to a method for producing the member.

BACKGROUND ART

A sintered member produced by a powder metallurgical method may be used as various kinds of mechanical parts because it can be formed in nearly a final shape and is suitable for mass production. In addition, it may also be applied to various kinds of sliding parts mentioned above because a special metallic structure can be easily obtained, which cannot be obtained by an ordinarily melted material. That is, in a sintered member produced by the powder metallurgical method, the member may be used as various kinds of sliding parts since a solid lubricating agent can be dispersed in a metallic structure by adding the powder of a solid lubricating agent, such as graphite or manganese sulfide or the like, to raw material powder, and by sintering them under conditions in which the solid lubricating agent remains, (see Japanese Unexamined Patent Application Publication No. Hei04(1992)-157140, No. 2006-052468, No. 2009-155696, etc.).

Conventionally, in a sintered sliding member, a solid lubricating agent such as graphite or manganese sulfide is added in the form of a powder, and remains as it is, and is not solid-solved, during sintering. Therefore, the solid lubricating agent is located eccentrically in pores or at particle interfaces of the powder. Since such a solid lubricating agent is not bound to a base in the pore or at the particle interfaces of the powder, fixing property between them may be decreased, and it may easily be separated from the base during sliding.

In addition, in a case in which graphite is used as the solid lubricating agent, it is necessary for the graphite to remain as free graphite after sintering and not be solid-solved graphite in the base during sintering. For this reason, sintering temperature should be lower than in a case of a typical iron-based sintered alloy. Therefore, binding between the particles by dispersing of raw material powder may be weakened, and the strength of the base may be decreased.

On the other hand, since the solid lubricating agent such as manganese sulfide does not easily solid-solve in the base during sintering, it is possible to perform sintering at a similar sintering temperature of a typical iron-based sintered alloy. However, the solid lubricating agent that is added in a powdered condition may exist among the raw material powder. Therefore, it may interfere with dispersion among the raw material powder, and the strength of the base may be reduced compared to a case in which the solid lubricating agent is not added. Accompanied by the deterioration of strength of the base, strength of the iron-based sintered member may also be deteriorated, and abrasion may easily be promoted during sliding since durability of the base may be decreased.

In view of such circumstances, an object of the present invention is to provide an iron-based sintered sliding member in which the solid lubricating agent is uniformly dispersed not only in the pores and at the particle interface of the powder, but also inside of the particle of powder, the agent is strongly fixed to the base, sliding property is superior, and mechanical strength is also superior.

SUMMARY OF THE INVENTION

The first aspect of the iron-based sintered sliding member of the present invention has S: 3.24 to 8.10 mass %, remainder: Fe and inevitable impurities as an overall composition; the metallic structure includes a ferrite base in which sulfide particles are dispersed, and pores; and the sulfide particles are dispersed at a ratio of 15 to 30 vol % versus the base.

Furthermore, the second aspect of the iron-based sintered sliding member of the present invention has S: 3.24 to 8.10 mass %, C: 0.2 to 2.0 mass %, remainder: Fe and inevitable impurities as an overall composition; the metallic structure includes a base in which sulfide particles are dispersed, and pores; the base is constructed by a structure of at least one of ferrite, pearlite and bainite or a mixed structure of these; and the sulfide particles are dispersed at a ratio of 15 to 30 vol % versus the base.

Furthermore, the third aspect of the iron-based sintered sliding member of the present invention has S: 3.24 to 8.10 mass %, C: 0.2 to 3.0 mass %, remainder: Fe and inevitable impurities as an overall composition; the metallic structure includes a base in which sulfide particles are dispersed, and pores; wherein the base is constructed by a structure at least one of ferrite, pearlite and bainite or a mixed structure of these, amount of the C which is solid solved is 0.2 or less, and part of or all of the C is dispersed in the pores as graphite; and the sulfide particles are dispersed at a ratio of 15 to 30 vol % versus the base.

In the iron-based sintered sliding member of the first and second aspects, it is desirable that in the sulfide particles, a ratio of total area of the sulfide particles having 10 μm or more of maximal particle diameter in a circle-equivalent diameter account for 60% or more of a total area of entirety of the sulfide particles. Furthermore, it is desirable that the member contains Cu: 20 mass % or less. Furthermore, it is desirable that the member contain at least one of Ni and Mo, at 13 mass % or less, each.

The method for production of the iron-based sintered sliding member of the present invention includes steps of preparing raw material powder by adding at least one kind of metallic sulfide powder selected from iron sulfide powder, copper sulfide powder, molybdenum disulfide powder and nickel sulfide powder to iron powder so that amount of S in the raw material powder is 3.24 to 8.10 mass %; compacting and molding the raw material powder in a mold; and sintering the compact at 1000 to 1300° C. under a non-oxidizing atmosphere.

In the method for production of the iron-based sintered sliding member of the present invention, it is desirable that copper powder or copper alloy powder be further added to the raw material powder, and the amount of Cu in the raw material powder be 20 mass % or less, and the sintering temperature is in a range of 1090 to 1300° C. Furthermore, it is desirable that iron alloy powder containing at least one kind of Ni and Mo be used instead of the iron powder, and Ni and Mo in the raw material powder is 13 mass % or less each, and it is desirable that nickel powder be further added to the raw material powder, and the amount of Ni in the raw material powder be 13 mass % or less. Furthermore, it is desirable that 0.2 to 2 mass % of graphite powder be further added to the raw material powder, and it is desirable that 0.2 to 3 mass % of graphite powder, 0.1 to 2.0 mass % of at least one kind powder selected from boric acid, borates, nitrides of boron, halides of boron, sulfides of boron and hydrides of boron be further added to the raw material powder.

In the iron based sintered sliding member of the present invention, since metallic sulfide particles mainly consisting of iron sulfide are segregated from the iron base and are dispersed in the iron base, it fits strongly to the base, thereby obtaining superior sliding property and strength.

BRIEF DESCRIPTION OF DRAWINGS

FIG. 1 is a photograph showing one example of a metallic structure of the iron-based sintered sliding member of the present invention.

BEST MODE FOR CARRYING OUT THE INVENTION

Hereinafter, the metallic structure and the basis of the numerical value limitations of the iron-based sintered sliding member of the present invention are explained together with the effects of the present invention. The iron-based sintered sliding member of the present invention contains Fe as a main component. Here, the main component means a component that accounts for more than a half of the sintered sliding member. In the present invention, the amount of Fe in the overall composition is desirably 50 mass % or more, and is more desirably 60 mass % or more. The metallic structure includes the iron base (iron alloy base) in which sulfide particles mainly containing Fe are dispersed, and pores. The iron base is formed by iron powder and/or iron alloy powder. The pores are caused by a powder metallurgical method, that is, gaps between powder particles during compacting and molding of the raw material powder may remain in the iron base formed by binding of the raw material powder.

Generally, the iron powder contains about 0.03 to 0.9 mass % of Mn as an inevitable impurity, due to the production method. Therefore, the iron base contains very small amounts of Mn as an inevitable impurity. Therefore, by adding S, sulfide particles such as manganese sulfide can be segregated in the base as a solid lubricating agent. Here, since manganese sulfide is segregated finely in the base, machinability can be improved; however, there may be only a small effect of improving sliding property since it is too fine. Therefore, in the present invention, in addition to the amount of S that reacts with Mn contained in the base in a small amount, a further amount of S is added in order to generate iron sulfide by combining the S with Fe, which is the main component.

Ordinarily, a sulfide may be generated more easily as a difference of electronegativity of an element versus S is greater. Since values of the electronegativity (Pauling's electronegativity) are as follows, S: 2.58, Mn: 1.55, Cr: 1.66, Fe: 1.83, Cu: 1.90, Ni: 1.91, and Mo: 2.16, a sulfide may be formed more easily in the following order, Mn>Cr>Fe>Cu>Ni>Mo. Therefore, in the case in which S is added in an amount exceeding the S amount forming MnS by combining all of the Mn contained in the iron powder, in addition to the reaction with the small amount of Mn, reaction with Fe, which is the main component may occur, and therefore, iron sulfide may be segregated in addition to manganese sulfide. Therefore, the sulfides that are segregated in the base may consist of a main iron sulfide generated by Fe, which is the main component, and a partial manganese sulfide generated by Mn, which is an inevitable impurity.

The iron sulfide is a sulfide particle having appropriate size to improve sliding property as a solid lubricating agent and is formed by binding with Fe, which is a main component of the base, and therefore, it can be segregated and dispersed uniformly in the base.

As mentioned above, in the present invention, S is added in an amount exceeding the S amount combining with Mn contained in the base, thereby combining S and Fe, which is the main component of the base, so as to segregate sulfide. In a case in which amount of sulfide particles segregated and dispersed in the base is less than 15 vol %, although lubricating effect can be obtained to some extent, sliding property may be decreased. On the other hand, in a case in which the amount of the sulfide particle exceeds 30 vol %, mechanical strength of the iron based sintered sliding member may be greatly reduced because the amount of sulfide versus the base is too great. Therefore, the amount of sulfide particles in the base is determined to be 15 to 30 vol % versus the base.

Since S has low chemical combining force at room temperature and has high reactivity at high temperature, it may combine with non-metallic elements such as H, O, C or the like, in addition to metal. In production of a sintered member, a mold lubricating agent is generally added to raw material powder, and then a so-called "dewaxing process" is generally performed in which the mold lubricating agent is removed by evaporation during a temperature increasing step in a sintering process. Here, if S is added in the condition of a sulfur powder, it may be separated by combining with a component (mainly H, O, C) which is generated by decomposing of the mold lubricating agent, and it becomes difficult to add a necessary amount of S to stably form the iron sulfide. Therefore, it is desirable that S be added in the condition of an iron sulfide powder and a sulfide powder of a metal having lower electronegativity than Fe, that is, a metallic sulfide powder such as copper sulfide powder, nickel sulfide powder, and molybdenum disulfide powder. In the case in which S is added in the condition of these metallic sulfide powders, since the metallic sulfide can exist as it is without being decomposed in a temperature range at which dewaxing process is performed (about 200 to 400° C.), it may not combine with a component generated by decomposing of the mold lubricating agent and S may not be separated. Therefore, S, which is necessary to form the iron sulfide, can be added stably.

In a case in which iron sulfide powder is used as the metallic sulfide, a eutectic liquid phase of Fe—S is generated at above 988° C. in a temperature increasing step of a sintering process, and growth of necks among powder particles is promoted by liquid phase sintering. Furthermore, since S is uniformly dispersed from this eutectic liquid phase to the iron base, the sulfide particles can be segregated and dispersed uniformly in the base.

In a case in which copper sulfide powder, nickel sulfide powder or molybdenum disulfide powder is used as the metallic sulfide powder, as is obvious from the value of the above electronegativity, these metallic sulfides have lower ability to form sulfide than Fe, and if added to the iron powder, S may be supplied by decomposing of the metallic sulfide powder during sintering. This decomposed S generates FeS by combining Fe around the metallic sulfide powder. A eutectic liquid phase of Fe—S is generated with Fe, and growth of necks among powder particles is promoted by liquid phase sintering. Furthermore, since S is uniformly dispersed from this eutectic liquid phase to the iron base, the sulfide particles mainly consisting of iron sulfide can be segregated and dispersed uniformly in the base.

Since it is more difficult for metallic component (Cu, Ni, Mo) which is generated by decomposing of the metallic sulfide powder to form metallic sulfide than Fe, most of them is dispersed and solid-solved in the iron base, thereby contributing to strengthening of the iron base. Furthermore, in a case in which they are used with C, hardenability of the iron base is improved, pearlite is made smaller and is strengthened, and bainite or martensite having high strength can be obtained at an ordinary cooling rate during sintering.

Among these metallic sulfide powders, in particular, in a case in which copper sulfide is used as the metallic sulfide powder, Cu that is generated by decomposing of copper sulfide powder generates a Cu liquid phase, and the Cu liquid phase covers the iron powder while wet, thereby being dispersed in iron powder. As mentioned above, Cu has low electronegativity than Fe, and Cu is more difficult to form a sulfide compared to Fe at room temperature; however, it may easily form a sulfide at high temperature since standard formation free energy thereof is smaller than Fe. Furthermore, Cu has a small solid solubility limit in α-Fe and thereby not generating any compound, therefore, Cu which is solid solved in γ-Fe at high temperature has a property in which the single element of Cu is segregated in α-Fe during the cooling process. Therefore, Cu that is once solid solved in sintering is uniformly segregated from the Fe base during the cooling process of the sintering. In this process, Cu and the iron sulfide may form metallic sulfide (copper sulfide, iron sulfide, and complex sulfide of iron and copper) with this Cu deposited from the base being the core, and in addition, sulfide particles (iron sulfide) are promoted to be segregated therearound.

It should be noted that in the case in which nickel sulfide powder or molybdenum disulfide powder is used as the metallic sulfide powder, most of them may be dispersed and solid solved in the iron base as mentioned above; however, there may be a case in which nickel sulfide or molybdenum disulfide remains because it has not yet decomposed, or a case in which nickel sulfide or molybdenum disulfide is segregated. However, these cases are not regarded as problems in particular, since most of nickel sulfide powder and molybdenum disulfide powder added may be decomposed, thereby contributing generation of iron sulfide, and in addition, nickel sulfide and molybdenum disulfide have lubricating properties.

Since the sulfide particles mentioned above are segregated by combining Mn or Fe in the base and S, they are segregated from the base and uniformly dispersed. Therefore, the sulfide is strongly fixed to the base and is rarely separated. Furthermore, since the sulfide is generated by segregating from the iron base, it may not inhibit dispersing of the raw material powder during sintering, and sintering is promoted by the Fe—S liquid phase and the Cu liquid phase. Therefore, the raw material powder is appropriately dispersed, strength of the iron base is improved, and wear resistance of the iron base is improved.

In order to exhibit solid lubricating action of sulfide, which is segregated in the base during sliding with an opposing member, it is desirable that the sulfide have a certain size larger than a fine size. From this viewpoint, it is desirable that total area of sulfide particles having maximal particle diameter as a circle equivalent diameter of 10 μm or more account for 30% of the total area of the entirety of the sulfide particles. In a case in which maximal particle diameter in a circular equivalent diameter of the sulfide particle is less than 10 μm, the solid lubricating action cannot be obtained sufficiently. Furthermore, in a case in which total area of sulfide particles having maximal particle diameter in a circular equivalent diameter of 10 μm or more is less than 30% of total area of entirety of sulfide particles, the solid lubricating action cannot be obtained sufficiently.

Generally, in an iron-based sintered alloy, in order to strengthen the iron base, element such as C, Cu, Ni, Mo or the like is solid solved in the iron base to use as an iron alloy, and the element for strengthening the iron base can be added similarly in the iron-based sintered sliding member of the present invention to form iron alloy base. Among these elements, Ni and Mo do not inhibit formation of sulfide particles mainly containing iron sulfide due to the electronegativity as mentioned above. Furthermore, Cu has an effect promoting formation of sulfide particles mainly containing iron sulfide. These elements have a action in which the base is strengthened by being solid solved in the iron base, and in addition, if used with C, they improve hardenability of the iron base and increase strength by making pearlite smaller, and bainite or martensite having high strength can be obtained at an ordinary cooling rate in sintering.

At least one kind of Ni and Mo can be added in the form of single element powder (nickel powder and molybdenum powder) or alloy powder containing another component (Fe—Mo alloy powder, Fe—Ni alloy powder, Fe—Ni—Mo alloy powder, Cu—Ni alloy powder and Cu—Mo alloy powder or the like). It should be noted that these materials are expensive and in a case in which too much component amount of the single element powder is added, a portion not dispersed yet remains in the iron base, and there may be a portion in which no sulfide is segregated. Therefore, it is desirable that Ni, and Mo be 13 mass % or less each, in the overall composition.

Cu can be added in the form of a copper element powder or a copper alloy powder. As mentioned above, Cu has the effect of promoting segregation of sulfide particles, and in addition, in a case in which amount of Cu is greater than amount of S, a soft free copper phase is segregated in the iron base, thereby improving affinity with an opposing member. However, if too much is added, the amount of free copper phase segregated may become too great, and strength of the iron-base sintered member may be extremely decreased. Therefore, the amount of Cu should be 20 mass % or less in the overall composition.

Since alloy powder becomes hard, thereby deteriorating compressibility of the raw material powder if C is added in the form of an alloy powder, C is added in the form of graphite powder. In a case in which the amount of addition of C is below 0.2 mass %, a ferrite having low strength may account for too much, and effect of addition may be too low. On the other hand, in a case in which the amount of addition is too great, a brittle cementite may be segregated in a network. Therefore, in the present invention, it is desirable that C be contained in 0.2 to 2.0 mass % and that all the amount of C be solid solved in the base or is segregated as a metallic carbide.

It should be noted that if C remains as graphite in the pores not being solid-solved in the base, this graphite may function as a solid lubricating agent. As a result, a friction coefficient is reduced, wear is reduced, and sliding property is improved. Therefore, in the present invention, it is desirable that C be contained in 0.2 to 3.0 mass % and that part of or all of C be dispersed in the pores as graphite. In this case, C is added in the condition of graphite powder. If the amount of addition of C is less than 0.2 mass %, the amount of graphite to be dispersed becomes too small, and the effect of improving sliding property may be insufficient. On the other hand, since graphite that remains in pores maintains the shape of the graphite powder added, the graphite prevents the pores from being spherical and strength may be easily deteriorated. Therefore, the upper limit of amount of addition of C is 3.0 mass %.

In order for C to remain in the pores in the condition of graphite, 0.2 to 3.0 mass % of graphite powder, and 0.1 to 2.0 mass % of at least one kind selected from boric acid, borates, nitrides of boron, halides of boron, sulfides of boron, hydrides of boron are added. These boron containing powders have low melting temperature, and liquid phase of boron oxide is generated at about 500° C. Therefore, at a step in which temperature of a compact containing graphite powder and boron containing powder is increased during a sintering process, the boron containing powder may be melted, and the liquid phase of boron oxide generated may be wet and cover the surface of the graphite powder. Therefore, C of the graphite powder is prevented from being dispersed to the Fe base that starts from about 800° C. during further temperature increase, and the graphite can be dispersed while remaining in the pores. It is desirable that the amount of the boron containing powder be an amount satisfying the covering of the graphite powder. Since excess amount of addition may cause deterioration of strength due to boron oxide remaining in the base, it is desirable that the amount of addition be 0.1 to 2.0 mass %.

The metallic structure of the iron base becomes a ferrite structure if C is not added. Furthermore, in a case in which C is added, the metallic structure of the iron base becomes ferrite if C remains in the pores as graphite. In addition, the metallic structure of the iron base becomes a mixed structure of ferrite and pearlite or pearlite if part of or all of C is dispersed in the iron base. The metallic structure of the iron base becomes a mixed structure of ferrite and pearlite, mixed structure of ferrite and bainite, mixed structure of ferrite and pearlite and bainite, mixed structure of pearlite and bainite, or any one metallic structure of pearlite and bainite, if at least one kind of Cu, Ni, Mo is used in combination with C. Furthermore, the metallic structure of the iron base becomes a metallic structure in which a free copper phase is dispersed in the iron base, if Cu is added and the amount of Cu is greater than the amount of S.

As is performed conventionally, the raw material mentioned above is filled in a cavity, and the cavity includes a mold having a mold hole forming an outer circumferential shape of a product, a lower punch which slidably engages the mold hole of the mold and forms a lower end surface of the product, and a core rod forming an inner circumferential shape or a part to reduce the weight of the product in some cases. After the raw material powder is compacted and molded by an upper punch forming an upper end surface of the product and the lower punch, a molded body is formed by a method in which product is extracted from the mold hole of the mold (mold pushing method).

The molded body obtained is heated in a sintering furnace so as to sinter it. Temperature of heating and holding at this time, that is, the sintering temperature, exerts an important influence on promotion of sintering and forming of sulfide. Here, in a case in which sintering temperature is less than 1000° C., Fe—S eutectic liquid phase is not generated and formation of sulfide mainly containing iron sulfide may be insufficient. Furthermore, in a case in which Cu is added as an additional element, since the melting point of Cu is 1084.5° C., it is desirable that the sintering temperature be 1090° C. or more in order to sufficiently generate a Cu liquid phase. On the other hand, if the sintering temperature is 1300° C. or more, the amount of the liquid phase generated may be too great and the shape may be easily damaged. It should be noted that the sintering atmosphere is desirably a non-oxidizing atmosphere, and since S easily reacts with H and O as mentioned above, an atmosphere having a low dew point is desirable.

EXAMPLES

Example 1

Iron sulfide powder (S amount: 36.47 mass %) was added to iron powder containing 0.03 mass % of Mn at the addition ratios shown in Table 1, and they were mixed to obtain raw material powders. Each of the raw material powders was molded at a molding pressure of 600 MPa, so as to produce a compact having a ring shape with an outer diameter of 25.6 mm, an inner diameter 20 mm, and a height 15 mm. Next, they were sintered at 1120° C. in a non-oxidizing gas atmosphere so as to produce sintered members of samples Nos. 01 to 08. The overall compositions of these samples are also shown in Table 1.

Vol % of the sulfide in the metallic structure equals the area ratio of sulfide of a cross section of the metallic structure. Therefore, in the Examples, in order to evaluate vol % of metallic sulfide, area % of the sulfide of cross section of the metallic structure was evaluated. That is, the sample obtained was cut, the cross section was polished to a mirror surface, and the cross section was observed. Using image analyzing software (trade name: WinROOF, produced by Mitani Shoji Co., Ltd.), the area of the base part and the sulfide except for pores was measured, and area % of all the sulfides versus the base was calculated, and in addition, the area of the sulfide having a maximal particle diameter of 10 μm or more was measured, and the ratio thereof versus the area of the entirety of the sulfide was calculated. It should be noted that maximal particle diameter of each sulfide particle was obtained by measuring an area of each particle and then converting a circle equivalent diameter, which diameter was obtained by a circle having the same area as the particle. Furthermore, in a case in which multiple sulfide particles are combined, the circle equivalent diameter was calculated depending on the area of the sulfide regarding the combined sulfide particles as one sulfide particle. These results are shown in Table 2.

In addition, using a thermal refined material of SCM435H defined in the Japanese Industrial Standard (JIS) as an opposing material, sliding test of the sintered member having a ring shape was performed by a ring on disk friction wear testing machine in a condition of rotation rate 477 rpm, load 5 kgf/cm$^2$ and without lubrication, and the friction coefficient thereof was measured. Furthermore, radial crushing testing of the sintered member having a ring shape was performed so as to measure the radial crushing strength. These results are also shown in Table 2.

It should be noted that in the following evaluation, samples having friction coefficient 0.6 or less and radial crushing strength of 150 MPa or more were regarded as "passing" the test.

TABLE 1

| Sample No. | Addition ratio (mass %) Iron powder Mn = 0.03% | Iron sulfide powder | Overall composition (mass %) Fe | Mn | S |
|---|---|---|---|---|---|
| 01 | Remainder | 0.00 | Remainder | 0.03 | 0.00 |
| 02 | Remainder | 5.00 | Remainder | 0.03 | 1.82 |
| 03 | Remainder | 8.88 | Remainder | 0.03 | 3.24 |
| 04 | Remainder | 10.00 | Remainder | 0.03 | 3.65 |
| 05 | Remainder | 15.00 | Remainder | 0.03 | 5.47 |
| 06 | Remainder | 20.00 | Remainder | 0.02 | 7.29 |
| 07 | Remainder | 22.20 | Remainder | 0.02 | 8.10 |
| 08 | Remainder | 25.00 | Remainder | 0.02 | 9.12 |

TABLE 2

| Sample No. | Amount of sulfide (area %) | Sulfide 10 μm or more (%) | Friction coefficient | Radial crushing strength (MPa) |
|---|---|---|---|---|
| 01 | 0.0 | 0 | 0.75 | 330 |
| 02 | 8.4 | 56 | 0.63 | 350 |
| 03 | 15.0 | 77 | 0.60 | 320 |
| 04 | 16.8 | 80 | 0.58 | 310 |
| 05 | 23.0 | 92 | 0.56 | 230 |
| 06 | 27.0 | 96 | 0.54 | 180 |
| 07 | 29.0 | 98 | 0.53 | 160 |
| 08 | 32.0 | 98 | 0.53 | 80 |

As is obvious from Tables 1 and 2, sulfide is segregated by adding iron sulfide powder, and the amount of S in the overall composition increased and the amount of segregation of sulfide is increased as the amount of addition of iron sulfide powder became greater. Furthermore, the ratio of sulfide having a maximal particle diameter of 10 μm or more is increased as the amount of S is increased. At 8.10% of the S amount which is the upper limit of the present invention, most of the sulfide has the maximal particle diameter of 10 μm or more. By such segregation of sulfide, the friction coefficient was decreased as the amount of S in the overall composition increased. Radial crushing strength increased since sintering was promoted by generation of a liquid phase during sintering due to addition of iron sulfide powder. However, since strength of the base was deteriorated as the amount of sulfide was segregated more in the base, and since the strength was deteriorated in a region containing a greater amount of S due to the large amount of segregation of sulfide, radial crushing strength was deteriorated.

Here, in the sample No. 02 in which the S amount in the overall composition was less than 3.24 mass %, since the S amount is low, the segregated amount of sulfide was less than 15 area %, and improvement effect in friction coefficient was low. On the other hand, in sample No. 03 in which the S amount in the overall composition was 3.24 mass %, the segregated amount of sulfide was 15 area %, the ratio accounted for by sulfide having a maximal particle diameter of 10 μm or more was more than 60%, and the friction coefficient was improved to 0.6 or less. On the other hand, if the S amount in the overall composition exceeds 8.1 mass %, as a result that amount of sulfide accounts for more than 30 area % of the base, radial crushing strength is extremely deteriorated, being less than 150 MPa. As mentioned above, it was confirmed that desirable friction coefficient and strength can be obtained in a range 3.24 to 8.1 mass % of the S amount in the overall composition.

FIG. 1 shows the metallic structure (mirror surface polishing) of the iron-based sintered sliding member of the sample No. 05. In FIG. 1, the iron base corresponds to the white part, and sulfide particles correspond to the gray part. Pores correspond to the black part. In FIG. 1, it can be observed that the sulfide particles (gray) are dispersed while being segregated in the iron base (white), and fixing property in the base is superior. Furthermore, sulfide particles are mutually bound at each location thereby growing to some extent of size. Since they are dispersed in the base while growing to large size in this way, they have function as a solid lubricating agent much, and it is thought that they contributes reducing friction coefficient. It should be noted that the shape of the pores (black) is relatively circular, and this is thought to be because of generation of an Fe—S liquid phase.

Example 2

Iron sulfide powder (S amount: 36.47 mass %) was added to iron powder containing 0.8 mass % of Mn at the addition ratios shown in Table 3, and they were mixed to obtain raw material powders. Performing molding and sintering in a manner similar to that in Example 1, sintered members of samples Nos. 09 to 16 were produced. The overall compositions of these samples are shown in Table 3. Regarding these samples, in a manner similar to that in Example 1, the area of all the sulfides, and ratio of area of sulfide having maximal particle diameter of 10 μm or more versus the area of all the sulfide were calculated, and in addition, friction coefficient and radial crushing strength were measured. These results are also shown in Table 4.

TABLE 3

| Sample No. | Addition ratio (mass %) Iron powder Mn = 0.8% | Iron sulfide powder | Overall composition (mass %) Fe | Mn | S |
|---|---|---|---|---|---|
| 09 | Remainder | 0.00 | Remainder | 0.80 | 0.00 |
| 10 | Remainder | 5.00 | Remainder | 0.76 | 1.82 |
| 11 | Remainder | 8.88 | Remainder | 0.73 | 3.24 |
| 12 | Remainder | 10.00 | Remainder | 0.72 | 3.65 |
| 13 | Remainder | 15.00 | Remainder | 0.68 | 5.47 |
| 14 | Remainder | 20.00 | Remainder | 0.64 | 7.29 |
| 15 | Remainder | 22.20 | Remainder | 0.62 | 8.10 |
| 16 | Remainder | 25.00 | Remainder | 0.60 | 9.12 |

TABLE 4

| Sample No. | Amount of sulfide (area %) | Sulfide 10 μm or more (%) | Friction coefficient | Radial crushing strength (MPa) |
|---|---|---|---|---|
| 09 | 0.0 | 0 | 0.74 | 310 |
| 10 | 8.2 | 43 | 0.62 | 320 |
| 11 | 15.0 | 60 | 0.59 | 320 |
| 12 | 16.6 | 68 | 0.57 | 310 |
| 13 | 22.0 | 90 | 0.56 | 240 |
| 14 | 26.0 | 94 | 0.54 | 180 |
| 15 | 28.0 | 96 | 0.52 | 160 |
| 16 | 31.0 | 98 | 0.52 | 90 |

Example 2 is an example in which iron powder containing an Mn amount that is different from that of the iron powder used in Example 1 (Mn amount: 0.03 mass %) is used; however, Example 2 exhibits a similar tendency to that in Example 1. That is, as is obvious from Tables 3 and 4, the S amount in the overall composition was increased and the segregated amount of sulfide was increased as the added amount of iron sulfide powder was increased. Furthermore, the ratio of sulfide having a maximal particle diameter of 10

μm or more was increased as the S amount was increased. At 8.10% of the S amount which is the upper limit of the present invention, most of the sulfide has the maximal particle diameter of 10 μm or more. By such segregation of sulfide, the friction coefficient was decreased as the S amount in the overall composition was increased. Radial crushing strength was increased since sintering was promoted by generating a liquid phase during sintering by addition of iron sulfide; however, strength of the base was deteriorated due to increase in the amount of sulfide segregated in the base. Therefore, in a region containing a large amount of S, strength was deteriorated due to increased amount of segregation of sulfide, and radial crushing strength was deteriorated.

Furthermore, as similar to Example 1, in the sample No. 10 in which the S amount in the overall composition was less than 3.24 mass %, since the S amount is low, the segregated amount of sulfide was less than 15 area %, and improvement effect on friction coefficient was low. On the other hand, in the sample No. 11 in which the S amount in the overall composition was 3.24 mass %, the segregated amount of sulfide was 15 area %, a ratio accounted for by sulfide having a maximal particle diameter 10 μm or more was 60%, and the friction coefficient was improved to 0.6 or less. On the other hand, if the S amount in the overall composition exceeded 8.1 mass %, as a result that amount of sulfide accounts for more than 30 area % of the base, radial crushing strength was extremely deteriorated, being less than 150 MPa. As mentioned above, it was confirmed that desirable friction coefficient and strength can be obtained in a range 3.24 to 8.1 mass % of the S amount in the overall composition.

Example 3

Copper sulfide powder (S amount: 33.53 mass %) was added to iron powder used in Example 1 (iron powder containing 0.03 mass % of Mn) at the addition ratios shown in Table 5, and they were mixed to obtain raw material powders. Performing molding and sintering in a manner similar to that in Example 1, sintered members of samples Nos. 17 to 23 were produced. The overall compositions of these samples are also shown in Table 5. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 6. It should be noted that the results of the sample No. 01 (sample not containing metallic sulfide powder) in Example 1 are also shown in Table 6.

TABLE 5

| Sample | Addition ratio (mass %) | | Overall composition (mass %) | | | |
|---|---|---|---|---|---|---|
| No. | Iron powder Mn = 0.03% | Copper sulfide powder | Fe | Mn | S | Cu |
| 01 | Remainder | 0.00 | Remainder | 0.03 | 0.00 | 0.00 |
| 17 | Remainder | 5.00 | Remainder | 0.03 | 1.68 | 3.32 |
| 18 | Remainder | 9.66 | Remainder | 0.03 | 3.24 | 6.42 |
| 19 | Remainder | 10.00 | Remainder | 0.03 | 3.35 | 6.65 |
| 20 | Remainder | 15.00 | Remainder | 0.03 | 5.03 | 9.97 |
| 21 | Remainder | 20.00 | Remainder | 0.02 | 6.71 | 13.29 |
| 22 | Remainder | 24.17 | Remainder | 0.02 | 8.10 | 16.07 |
| 23 | Remainder | 25.00 | Remainder | 0.02 | 8.38 | 16.62 |

TABLE 6

| Sample No. | Amount of sulfide (area %) | Sulfide 10 μm or more (%) | Friction coefficient | Radial crushing strength (MPa) |
|---|---|---|---|---|
| 01 | 0.0 | 0 | 0.75 | 330 |
| 17 | 7.5 | 52 | 0.62 | 340 |
| 18 | 15.0 | 72 | 0.58 | 330 |
| 19 | 15.8 | 74 | 0.57 | 330 |
| 20 | 20.0 | 87 | 0.55 | 290 |
| 21 | 26.0 | 94 | 0.53 | 250 |
| 22 | 30.0 | 98 | 0.52 | 170 |
| 23 | 31.0 | 98 | 0.52 | 140 |

Example 3 is an example in which S was added by copper sulfide powder instead of iron sulfide powder, and Example 3 exhibits a tendency similar to Example 1. That is, as is obvious from Tables 5 and 6, the S amount in the overall composition is increased and the segregated amount of sulfide is increased as the added amount of copper sulfide powder is increased. Furthermore, the ratio of sulfide having maximal particle diameter of 10 μm or more is increased as the S amount is increased. At 8.10% of the S amount which is the upper limit of the present invention, most of the sulfide has the maximal particle diameter of 10 μm or more. By such segregation of sulfide, the friction coefficient is decreased as the S amount in the overall composition is increased. Radial crushing strength is increased since sintering is promoted by generating a liquid phase during sintering due to addition of copper sulfide; however, the strength of the base is deteriorated due to increasing of the amount of sulfide segregated in the base. Therefore, in a region containing a large amount of S, strength is deteriorated due to increased amount of segregation of sulfide, and radial crushing strength is deteriorated.

Furthermore, as similar to Example 1, in the sample No. 17 in which the S amount in the overall composition is less than 3.24 mass %, since the S amount is low, the segregated amount of sulfide is less than 15 area %, and improvement effects on the friction coefficient is low. On the other hand, in the sample No. 18 in which the S amount in the overall composition is 3.24 mass %, the segregated amount of sulfide is 15 area %, the ratio accounted for by the sulfide having a maximal particle diameter of 10 μm or more is 60%, and the friction coefficient is improved to 0.6 or less. On the other hand, if the S amount in the overall composition exceeds 8.1 mass %, as a result that the amount of sulfide accounts for 30 area % in the base, radial crushing strength is extremely deteriorated, being less than 150 MPa.

In the case in which S is added by copper sulfide powder instead of iron sulfide powder, the Cu which is generated by decomposing copper sulfide powder has an action of promoting segregation of sulfide particles, and the segregation amount is greater than in the case in which S is supplied by iron sulfide powder (Example 1), and the friction coefficient is smaller. Furthermore, since this Cu acts to densify by generation of a liquid phase (promoting of sintering) and to strengthen the base, and also the radial crushing strength has a higher value than in the case in which S is added by iron sulfide (Example 1).

As mentioned above, it was confirmed that desirable friction coefficient and strength can be obtained in a range 3.24 to 8.1 mass % of the S amount in the overall composition. In addition, it was confirmed that the similar results can be obtained in the case in which S was added by copper sulfide powder instead of iron sulfide powder.

Example 4

Molybdenum disulfide powder (S amount: 40.06 mass %) was added to iron powder used in Example 1 (iron powder containing 0.03 mass % of Mn) at the addition ratios shown in Table 7, and they were mixed to obtain raw material powders. Performing molding and sintering in a manner similar to that in Example 1, sintered members of samples Nos. 24 to 30 were produced. The overall compositions of these samples are also shown in Table 7. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 8. It should be noted that the results of the sample No. 01 (sample not containing metallic sulfide powder) in Example 1 are also shown in Table 8.

TABLE 7

| Sample | Addition ratio (mass %) | | Overall composition (mass %) | | | |
|---|---|---|---|---|---|---|
| No. | Iron powder Mn = 0.03% | $MoS_2$ powder | Fe | Mn | S | Cu |
| 01 | Remainder | 0.00 | Remainder | 0.03 | 0.00 | 0.00 |
| 24 | Remainder | 5.00 | Remainder | 0.03 | 2.00 | 3.00 |
| 25 | Remainder | 8.09 | Remainder | 0.03 | 3.24 | 4.85 |
| 26 | Remainder | 10.00 | Remainder | 0.03 | 4.01 | 5.99 |
| 27 | Remainder | 15.00 | Remainder | 0.03 | 6.01 | 8.99 |
| 28 | Remainder | 20.00 | Remainder | 0.02 | 8.01 | 11.99 |
| 29 | Remainder | 20.22 | Remainder | 0.02 | 8.10 | 12.12 |
| 30 | Remainder | 25.00 | Remainder | 0.02 | 10.02 | 14.99 |

TABLE 8

| Sample No. | Amount of sulfide (area %) | Sulfide 10 μm or more (%) | Friction coefficient | Radial crushing strength (MPa) |
|---|---|---|---|---|
| 01 | 0.0 | 0 | 0.75 | 330 |
| 24 | 7.5 | 58 | 0.61 | 380 |
| 25 | 15.0 | 75 | 0.56 | 400 |
| 26 | 17.0 | 80 | 0.55 | 420 |
| 27 | 25.0 | 92 | 0.53 | 430 |
| 28 | 29.0 | 98 | 0.51 | 400 |
| 29 | 29.0 | 98 | 0.51 | 400 |
| 30 | 35.0 | 98 | 0.52 | 280 |

Example 4 is an example in which S was added by molybdenum disulfide powder instead of iron sulfide powder, and Example 4 exhibits a tendency similar to Example 1. That is, as is obvious from Table 8, the S amount in the overall composition is increased and the segregated amount of sulfide is increased as the added amount of molybdenum disulfide powder is increased. Furthermore, the ratio of sulfide having maximal particle diameter of 10 μm or more is increased as the S amount is increased. At 8.10% of the S amount which is the upper limit of the present invention, most of the sulfide has the maximal particle diameter of 10 μm or more. By such segregation of sulfide, the friction coefficient is decreased as the S amount in the overall composition is increased. Radial crushing strength is increased since sintering is promoted by generating a liquid phase during sintering due to addition of copper sulfide; however, the strength of the base is deteriorated due to increasing of the amount of sulfide segregated in the base. Therefore, in a region containing a large amount of S, strength is deteriorated due to increased amount of segregation of sulfide, and radial crushing strength is deteriorated.

Furthermore, as similar to Example 1, in the sample No. 24 in which the S amount in the overall composition is less than 3.24 mass %, since the S amount is low, the segregated amount of sulfide is less than 15 area %, and improvement effects on the friction coefficient is low. On the other hand, in the sample No. 25 in which the S amount in the overall composition is 3.24 mass %, the segregated amount of sulfide is 15 area %, the ratio accounted for by the sulfide having a maximal particle diameter of 10 μm or more is 60%, and the friction coefficient is improved to 0.6 or less. On the other hand, if the S amount in the overall composition exceeds 8.1 mass %, the amount of sulfide accounts for more than 30 area % in the base, and radial crushing strength is extremely deteriorated; however, friction coefficient is not decreased so much considering the added amount. Since Mo and molybdenum disulfide powder are expensive, from the viewpoint that strength is extremely deteriorated and that effect is low considering cost, it is desirable that the Mo amount be 13 mass % or less.

In the case in which S is added by molybdenum disulfide powder instead of iron sulfide powder, the Mo which is generated by decomposing molybdenum disulfide powder is dispersed and solid solved in the iron base, and acts to strengthen the base. Therefore, the radial crushing strength has a higher value than in the case in which S is added by iron sulfide (Example 1).

As mentioned above, it was confirmed that desirable friction coefficient and strength can be obtained in a range 3.24 to 8.1 mass % of the S amount in the overall composition. In addition, it was confirmed that the similar results can be obtained in the case in which S was added by molybdenum disulfide powder instead of iron sulfide powder.

From the results in Examples 1 to 4, it was confirmed that amount of sulfide accounts for 15 to 30 area % in the base, it was confirmed that the ratio of total area of sulfide having a maximal particle diameter of 10 μm or more accounts for 60% of the total area of entirety of sulfide, and it was confirmed that appropriate friction coefficient of 0.6 or less and appropriate radial crushing strength of 150 MPa or more are exhibited, in the case in which the S amount in the overall composition is in a range of 3.24 to 8.1 mass %. Furthermore, within an amount of Mn of an extent which is contained in iron powder as an impurity, it was confirmed that similar results can be obtained even if the Mn amount varies. Furthermore, by using a metallic sulfide powder having electronegativity less than that of Fe, it was confirmed that the above mentioned sulfide can be formed.

Example 5

15 mass % of iron sulfide powder was added to iron powder used in Example 1, and furthermore, copper powder was added at the addition ratios shown in Table 9, and they were mixed to obtain raw material powders. Performing molding and sintering in a manner similar to that in Example 1, sintered members of samples Nos. 31 to 35 were produced. The overall compositions of these samples are also shown in Table 9. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 10. It should be noted that the results of the sample No. 05 (sample not containing copper powder) in Example 1 are also shown in Table 10.

TABLE 9

| Sample No. | Addition ratio (mass %) Iron powder Mn = 0.03% | Iron sulfide powder | Copper powder | Overall composition (mass %) Fe | Mn | S | Cu |
|---|---|---|---|---|---|---|---|
| 05 | Remainder | 15.00 | 0.00 | Remainder | 0.03 | 5.47 | 0.00 |
| 31 | Remainder | 15.00 | 5.00 | Remainder | 0.02 | 5.47 | 5.00 |
| 32 | Remainder | 15.00 | 10.00 | Remainder | 0.02 | 5.47 | 10.00 |
| 33 | Remainder | 15.00 | 15.00 | Remainder | 0.02 | 5.47 | 15.00 |
| 34 | Remainder | 15.00 | 20.00 | Remainder | 0.02 | 5.47 | 20.00 |
| 35 | Remainder | 15.00 | 25.00 | Remainder | 0.02 | 5.47 | 25.00 |

TABLE 10

| Sample No. | Amount of sulfide (area %) | Sulfide 10 μm or more (%) | Friction coefficient | Radial crushing strength (MPa) |
|---|---|---|---|---|
| 05 | 23.0 | 92 | 0.56 | 230 |
| 31 | 24.0 | 93 | 0.55 | 240 |
| 32 | 26.0 | 94 | 0.54 | 260 |
| 33 | 28.0 | 95 | 0.52 | 280 |
| 34 | 29.0 | 95 | 0.52 | 250 |
| 35 | 29.0 | 95 | 0.52 | 140 |

As is obvious from Tables 9 and 10, in the case in which the Cu amount of the overall composition was varied by varying the added amount of copper powder, segregation of sulfide powder was promoted as the Cu amount was increased, the amount of sulfide was increased, and the amount of sulfide particles having maximal particle diameter 10 μm or more was increased. Therefore, there was a tendency the friction coefficient was decreased. Radial crushing strength was increased until the Cu amount was 15 mass %, due to the fact that a liquid phase generating amount increased as the Cu amount was increased, thereby being densified, and due to action of base strengthening. However, in a case in which the Cu amount was more than 15 mass %, the amount of free copper phase that was dispersed in the base was increased and radial crushing strength was decreased. In addition in a case in which the Cu amount was over 20 mass %, radial crushing strength was extremely decreased to be below 150 MPa.

From the results of this Example and Example 3, it was confirmed that segregation of sulfide particles was promoted and the friction coefficient was reduced by adding Cu. It should be noted that since strength is extremely deteriorated in a case in which the Cu amount is over 20 mass %, it was confirmed that the upper limit should be desirably 20 mass % if Cu is added.

Example 6

15 mass % of iron sulfide powder and 10 mass % of copper powder were added to iron powder used in Example 1, and furthermore, nickel powder was added at the addition ratios shown in Table 11, and they were mixed to obtain raw material powders. Performing molding and sintering in a manner similar to that in Example 1, sintered members of samples Nos. 36 to 40 were produced. The overall compositions of these samples are also shown in Table 11. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 12. It should be noted that the results of the sample No. 32 (sample not containing nickel powder) in Example 5 are also shown in Table 12.

TABLE 11

| Sample No. | Addition ratio (mass %) Iron powder Mn = 0.03% | Iron sulfide powder | Copper powder | Nickel powder | Overall composition (mass %) Fe | Mn | S | Cu | Ni |
|---|---|---|---|---|---|---|---|---|---|
| 32 | Remainder | 15.00 | 10.00 | 0.00 | Remainder | 0.02 | 5.47 | 10.00 | 0.00 |
| 36 | Remainder | 15.00 | 10.00 | 2.50 | Remainder | 0.02 | 5.47 | 10.00 | 2.50 |
| 37 | Remainder | 15.00 | 10.00 | 5.00 | Remainder | 0.02 | 5.47 | 10.00 | 5.00 |
| 38 | Remainder | 15.00 | 10.00 | 10.00 | Remainder | 0.02 | 5.47 | 10.00 | 10.00 |
| 39 | Remainder | 15.00 | 10.00 | 13.00 | Remainder | 0.02 | 5.47 | 10.00 | 13.00 |
| 40 | Remainder | 15.00 | 10.00 | 15.00 | Remainder | 0.02 | 5.47 | 10.00 | 15.00 |

TABLE 12

| Sample No. | Amount of sulfide (area %) | Sulfide 10 μm or more (%) | Friction coefficient | Radial crushing strength (MPa) |
|---|---|---|---|---|
| 32 | 26.0 | 94 | 0.54 | 260 |
| 36 | 26.0 | 94 | 0.54 | 280 |
| 37 | 26.0 | 94 | 0.53 | 300 |
| 38 | 26.0 | 94 | 0.53 | 300 |
| 39 | 26.0 | 94 | 0.53 | 280 |
| 40 | 26.0 | 94 | 0.61 | 250 |

As is obvious from Tables 11 and 12, in the case in which Ni amount in the overall composition is varied by varying amount of addition of nickel powder, the iron base is strengthened and radial crushing strength is increased until 5 mass % of Ni amount, as the Ni amount increased. However, depending on increasing of Ni amount, since amount of Ni rich phase (high Ni concentration phase) in which Ni remains not dispersing in the iron base is increased and thereby decreasing strength, radial crushing strength is at the same level at more than 5 mass % and up to 10 mass % because effects of base strengthening and Ni rich phase are balanced. In a case in which Ni amount is more than 10 mass %, influence by the Ni rich phase becomes larger, and thus radial crushing strength is decreased. On the other hand, since the Ni rich phase in which sulfide is rarely segregated is increased depending on increasing the Ni amount, friction coefficient is slightly increased. However, in a case in which the Ni amount is more than 13 mass %, since the Ni rich phase is increased too much, friction coefficient is extremely increased, more than 6.

From the above mentioned results, it was confirmed that strength can be improved by adding Ni, and it was confirmed that the upper limit is desirably 13 mass % or less because strength may be decreased and friction coefficient may be increased at more than 13 mass % of Ni amount. Furthermore, from the results of this Example 6 and above Example 4, it was confirmed that strength can be improved by adding Ni and Mo at 13 mass % or less, each.

Example 7

15 mass % of iron sulfide powder and 10 mass % of copper powder were added to iron powder used in Example 1, and furthermore, graphite powder was added at the addition ratios shown in Table 13, and they were mixed to obtain raw material powders. Performing molding and sintering in a manner similar to that in Example 1, sintered members of samples Nos. 41 to 51 were produced. The overall compositions of these samples are also shown in Table 13. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 14. It should be noted that the results of the sample No. 32 (sample not containing graphite powder) in Example 5 are also shown in Table 14.

TABLE 13

| Sample No. | Addition ratio (mass %) Iron powder Mn = 0.03% | Iron sulfide powder | Copper powder | Graphite powder | Overall composition (mass %) Fe | Mn | S | Cu | C |
|---|---|---|---|---|---|---|---|---|---|
| 32 | Remainder | 15.00 | 10.00 | 0.00 | Remainder | 0.02 | 5.47 | 10.00 | 0.00 |
| 41 | Remainder | 15.00 | 10.00 | 0.20 | Remainder | 0.02 | 5.47 | 10.00 | 0.20 |
| 42 | Remainder | 15.00 | 10.00 | 0.40 | Remainder | 0.02 | 5.47 | 10.00 | 0.40 |
| 43 | Remainder | 15.00 | 10.00 | 0.60 | Remainder | 0.02 | 5.47 | 10.00 | 0.60 |
| 44 | Remainder | 15.00 | 10.00 | 0.80 | Remainder | 0.02 | 5.47 | 10.00 | 0.80 |
| 45 | Remainder | 15.00 | 10.00 | 1.00 | Remainder | 0.02 | 5.47 | 10.00 | 1.00 |
| 46 | Remainder | 15.00 | 10.00 | 1.20 | Remainder | 0.02 | 5.47 | 10.00 | 1.20 |
| 47 | Remainder | 15.00 | 10.00 | 1.40 | Remainder | 0.02 | 5.47 | 10.00 | 1.40 |
| 48 | Remainder | 15.00 | 10.00 | 1.60 | Remainder | 0.02 | 5.47 | 10.00 | 1.60 |
| 49 | Remainder | 15.00 | 10.00 | 1.80 | Remainder | 0.02 | 5.47 | 10.00 | 1.80 |
| 50 | Remainder | 15.00 | 10.00 | 2.00 | Remainder | 0.02 | 5.47 | 10.00 | 2.00 |
| 51 | Remainder | 15.00 | 10.00 | 2.20 | Remainder | 0.02 | 5.47 | 10.00 | 2.20 |

TABLE 14

| Sample No. | Amount of sulfide (area %) | Sulfide 10 μm or more (%) | Friction coefficient | Radial crushing strength (MPa) |
|---|---|---|---|---|
| 32 | 26.0 | 94 | 0.54 | 260 |
| 41 | 26.0 | 94 | 0.53 | 350 |
| 42 | 26.0 | 93 | 0.53 | 370 |
| 43 | 25.0 | 93 | 0.52 | 390 |
| 44 | 25.0 | 93 | 0.52 | 420 |
| 45 | 25.0 | 93 | 0.51 | 440 |
| 46 | 25.0 | 93 | 0.51 | 430 |
| 47 | 24.0 | 93 | 0.52 | 420 |
| 48 | 24.0 | 92 | 0.52 | 400 |
| 49 | 24.0 | 92 | 0.53 | 380 |
| 50 | 24.0 | 92 | 0.55 | 330 |
| 51 | 22.0 | 90 | 0.61 | 250 |

Example 7 is an example in which C is added in the iron-based sintered sliding member, and the entire amount of C is solid-solved in the iron base. The sample No. 32 in Example 5 does not contain C, and the metallic structure of the iron base thereof is a ferrite structure having low strength. Here, in a case in which C is added by adding graphite powder, a pearlite structure having higher strength than that of the ferrite structure is dispersed in the ferrite structure of the metallic structure of the iron base, radial crushing strength is increased and friction coefficient is decreased. In addition, as the amount of C is increased, the amount of the pearlite phase is increased and the ferrite phase is decreased. At about 1 mass % of the C amount, all of the metallic structure of the iron base may be a pearlite structure. Therefore, until 1 mass % of the C amount, radial crushing strength is increased and the friction coefficient is decreased as the C amount is increased. On the other hand, if the C amount is greater than 1 mass %, cementite which is hard and brittle may be segregated in a pearlite structure, radial crushing strength is decreased and friction coefficient is increased. If the C amount is greater than 2 mass %, the amount of cementite which is segregated in the pearlite structure is too great, and radial crushing strength is extremely low, being below the radial crushing strength of the sample No. 32 in which C is not added, and friction coefficient is increased, being more than 0.6.

As mentioned above, it was confirmed that strength can be improved by adding C and solid-solving it in the iron base, and that it is desirable that the upper limit be 2 mass % or less since strength is decreased and friction coefficient is increased if the C amount is greater than 2 mass %.

Example 8

15 mass % of iron sulfide powder, 10 mass % of copper powder and 0.5 mass % of boron oxide powder were added to iron powder used in Example 1, and furthermore, graphite powder was added at the addition ratios shown in Table 15, and they were mixed to obtain raw material powders. Performing molding and sintering in a manner similar to that in Example 1, sintered members of samples Nos. 52 to 62 were produced. The overall compositions of these samples are also shown in Table 15. Regarding these samples, in a manner similar to that in Example 1, the area of all of the sulfides, and the ratio of area of sulfide having maximal particle diameter of 10 μm or more versus the area of all of the sulfide were calculated, and in addition, friction coefficient and radial crushing strength were measured. These results are shown in Table 16. It should be noted that the results of the sample No. 32 (sample not containing graphite powder) in Example 5 are also shown in Table 16.

TABLE 15

| Sample No. | Addition ratio (mass %) Iron powder Mn = 0.03% | Iron sulfide powder | Copper powder | Graphite powder | Boron oxide powder | Overall composition (mass %) Fe | Mn | S | Cu | C | B |
|---|---|---|---|---|---|---|---|---|---|---|---|
| 32 | Remainder | 15.00 | 10.00 | 0.00 | 0.00 | Remainder | 0.02 | 5.47 | 10.00 | 0.00 | 0.00 |
| 52 | Remainder | 15.00 | 10.00 | 0.20 | 0.50 | Remainder | 0.02 | 5.47 | 10.00 | 0.20 | 0.16 |
| 53 | Remainder | 15.00 | 10.00 | 0.40 | 0.50 | Remainder | 0.02 | 5.47 | 10.00 | 0.40 | 0.16 |
| 54 | Remainder | 15.00 | 10.00 | 0.60 | 0.50 | Remainder | 0.02 | 5.47 | 10.00 | 0.60 | 0.16 |
| 55 | Remainder | 15.00 | 10.00 | 0.80 | 0.50 | Remainder | 0.02 | 5.47 | 10.00 | 0.80 | 0.16 |
| 56 | Remainder | 15.00 | 10.00 | 1.00 | 0.50 | Remainder | 0.02 | 5.47 | 10.00 | 1.00 | 0.16 |
| 57 | Remainder | 15.00 | 10.00 | 1.50 | 0.50 | Remainder | 0.02 | 5.47 | 10.00 | 1.50 | 0.16 |
| 58 | Remainder | 15.00 | 10.00 | 2.00 | 0.50 | Remainder | 0.02 | 5.47 | 10.00 | 2.00 | 0.16 |
| 59 | Remainder | 15.00 | 10.00 | 2.40 | 0.50 | Remainder | 0.02 | 5.47 | 10.00 | 2.40 | 0.16 |
| 60 | Remainder | 15.00 | 10.00 | 2.80 | 0.50 | Remainder | 0.02 | 5.47 | 10.00 | 2.80 | 0.16 |
| 61 | Remainder | 15.00 | 10.00 | 3.00 | 0.50 | Remainder | 0.02 | 5.47 | 10.00 | 3.00 | 0.16 |
| 62 | Remainder | 15.00 | 10.00 | 3.20 | 0.50 | Remainder | 0.02 | 5.47 | 10.00 | 3.20 | 0.16 |

TABLE 16

| Sample No. | Amount of sulfide (area %) | Sulfide 10 μm or more (%) | Friction coefficient | Radial crushing strength (MPa) |
|---|---|---|---|---|
| 32 | 26.0 | 94 | 0.54 | 260 |
| 52 | 25.0 | 94 | 0.52 | 250 |
| 53 | 25.0 | 94 | 0.51 | 240 |
| 54 | 25.0 | 94 | 0.51 | 240 |
| 55 | 25.0 | 93 | 0.51 | 230 |
| 56 | 24.0 | 93 | 0.50 | 230 |
| 57 | 24.0 | 93 | 0.50 | 220 |
| 58 | 24.0 | 92 | 0.50 | 220 |
| 59 | 23.0 | 92 | 0.49 | 210 |
| 60 | 23.0 | 92 | 0.49 | 190 |
| 61 | 23.0 | 92 | 0.49 | 150 |
| 62 | 22.0 | 91 | 0.49 | 80 |

Example 8 is an example in which C is added in the iron-based sintered sliding member, and C is remained in the pores so as to use as a solid lubricating agent, not solid-solving in the iron base. From the results of Tables 15 and 16, in the case in which C amount in overall composition is varied by varying added amount of graphite powder, the graphite powder which is dispersed in the pores depending on increasing of C amount acts as a solid lubricating agent, and friction coefficient is decreased. On the other hand, since amount of the iron base is decreased while amount of the graphite powder is increased, radial crushing strength is decreased. In the case in which added amount of the graphite powder is more than 3 mass %, radial crushing strength is extremely decreased, being less than 150 MPa.

As mentioned above, it was confirmed that friction coefficient is effectively reduced by adding graphite powder and remaining it in pores; however, the upper limit of the C amount is desirably 3 mass % or less because strength may be extremely decreased in the case in which the C amount is more than 3 mass %

In the iron-based sintered sliding member of the present invention, since metallic sulfide particles mainly containing iron sulfide are segregated from the iron base and are dispersed in the iron base, they are strongly fixed to the base, thereby obtaining superior sliding property and strength. Therefore, the present invention can be applied to various kinds of sliding parts.

What is claimed is:

1. An iron-based sintered sliding member comprising:

S: 3.24 to 8.10 mass %,

Cu as an optional element: 20 mass % or less,

Ni and Mo as optional elements: 13 mass % or less, respectively, and remainder: Fe and inevitable impurities, as an overall composition, wherein the metallic structure of the iron-based sintered sliding member comprises a ferrite base in which sulfide particles, of which iron sulfide is in the majority, are precipitated and uniformly dispersed, and pores, wherein the sulfide particles are dispersed at a ratio of 15 to 30 vol % versus the base, and wherein the iron sulfide is generated from the eutectic liquid phase of Fe—S sintering.

2. An iron-based sintered sliding member comprising: S: 3.24 to 8.10 mass %, C: 0.2 to 2.0 mass %, Cu as an optional element: 20 mass % or less, Ni and Mo as optional elements: 13 mass % or less, respectively, and remainder: Fe and inevitable impurities, as an overall composition, wherein the metallic structure of the iron-based sintered sliding member comprises a base in which sulfide particles, of which iron sulfide is in the majority, are precipitated and uniformly dispersed, and pores, wherein the base is constructed by a structure of at least one of ferrite, pearlite, and bainite or a mixed structure of these, wherein the sulfide particles are dispersed at a ratio of 15 to 30 vol % versus the base, and wherein the iron sulfide is generated from the eutectic liquid phase of Fe—S sintering.

3. An iron-based sintered sliding member comprising: S: 3.24 to 8.10 mass %, C: 0.2 to 3.0 mass %, Cu as an optional element: 20 mass % or less, Ni and Mo as optional elements:

13 mass % or less, respectively, and remainder: Fe and inevitable impurities, as an overall composition, wherein the metallic structure of the iron-based sintered sliding member comprises a base in which sulfide particles, of which iron sulfide is in the majority, are precipitated and uniformly dispersed, and pores, wherein the base is constructed by a structure of at least one of ferrite, pearlite and bainite or a mixed structure of these, an amount of the C which is solid solved is 0.2 mass % or less, and part of or all of the C is dispersed in the pores as graphite, wherein the sulfide particles are dispersed at a ratio of 15 to 30 vol % versus the base, and wherein the iron sulfide is generated from the eutectic liquid phase of Fe—S sintering.

4. The iron-based sintered sliding member according to claim 1, wherein in the sulfide particles, a total area of the sulfide particles having 10 μm or more of maximal particle diameter accounts 60% or more of a total area of entire of the sulfide particles.

5. A method for production of the iron-based sintered sliding member of claim 1, comprising the steps of: preparing a raw material powder by adding at least one kind of metallic sulfide powder, copper sulfide powder, molybdenum disulfide powder and nickel sulfide powder to iron powder so that an amount of S in the raw material powder is 3.24 to 8.10 mass %, compacting and molding the raw material powder in a mold, and sintering the compact at 1000 to 1300° C. under non-oxidizing atmosphere.

6. The method for production of the iron-based sintered sliding member according to claim 5, wherein copper powder or copper alloy powder is further added to the raw material powder, and the amount of Cu in the raw material powder is 20 mass % or less, and the sintering temperature is in a range of 1090 to 1300° C.

7. The method for production of the iron-based sintered sliding member according to claim 5, wherein nickel powder is further added to the raw material powder, and the amount of Ni in the raw material powder is 13 mass % or less.

8. The method for production of the iron-based sintered sliding member according to claim 5, wherein 0.2 to 2 mass % of graphite powder is further added to the raw material powder.

9. The method for production of the iron-based sintered sliding member according to claim 5, wherein 0.2 to 3 mass % of graphite powder, 0.1 to 2.0 mass % of at least one powder selected from boric acid, borates, nitrides of boron, halides of boron, sulfides of boron and hydrides of boron is further added to the raw material powder.

10. The iron-based sintered sliding member according to claim 2, wherein in the sulfide particles, a total area of the sulfide particles having 10 μm or more of maximal particle diameter accounts 60% or more of a total area of entire of the sulfide particles.

11. The iron-based sintered sliding member according to claim 3, wherein in the sulfide particles, a total area of the sulfide particles having 10 μm or more of maximal particle diameter accounts 60% or more of a total area of entire of the sulfide particles.

12. The iron-based sintered sliding member according to claim 1, wherein the friction coefficient is not greater than 0.6.

13. The iron-based sintered sliding member according to claim 2, wherein the friction coefficient is not greater than 0.6.

14. The iron-based sintered sliding member according to claim 3, wherein the friction coefficient is not greater than 0.6.

* * * * *